US006722354B1

(12) United States Patent
Land

(10) Patent No.: US 6,722,354 B1
(45) Date of Patent: Apr. 20, 2004

(54) ARCHERY BOW CABLE GUARD

(75) Inventor: Spencer D. Land, Henderson, NV (US)

(73) Assignee: Spenco, Dunlap, TN (US)

( * ) Notice: Subject to any disclaimer, the term of this patent is extended or adjusted under 35 U.S.C. 154(b) by 0 days.

(21) Appl. No.: 10/167,010

(22) Filed: Jun. 11, 2002

(51) Int. Cl.[7] ..... F41B 5/10
(52) U.S. Cl. ..... 124/25.6
(58) Field of Search ..... 124/25.6, 86, 88

(56) References Cited

U.S. PATENT DOCUMENTS 4,203,412 A * 5/1980 Rickard
4,207,858 A * 6/1980 Blackstone
4,683,865 A * 8/1987 Troncoso
4,718,397 A * 1/1988 Remick
4,917,070 A * 4/1990 Townsend
4,971,020 A * 11/1990 Soderstrom et al.
5,722,385 A * 3/1998 Bunk ..... 124/86
5,983,880 A * 11/1999 Saunders ..... 124/25.6
6,098,607 A * 8/2000 Strother ..... 124/25.6

* cited by examiner

*Primary Examiner*—John A. Ricci
(74) *Attorney, Agent, or Firm*—Reising, Ethington, Barnes, Kisselle, P.C.

(57) ABSTRACT

An archery bow has a cable guard with at least one guide pulley rotatably carried by the cable guard to receive at least one harness string portion and maintain the harness string portion out of a user's way while using the bow. The archery bow has a body or riser with a handle portion and a pair of limbs each having a free end spaced from the handle portion. A separate pulley is rotatably carried adjacent the free ends of each limb and at least one string is trained around the pulleys and has a draw string portion and at least one harness string portion. The harness string portion is trained around at least a portion of a guide pulley, and if more than one harness string portion is provided, then each harness string portion may be trained around a separate guide pulley to maintain the harness string portions separate from each other and to maintain each harness string portion in a laterally spaced relation from the drawstring portion.

20 Claims, 2 Drawing Sheets

ARCHERY BOW CABLE GUARD

BACKGROUND OF THE INVENTION

1. Field of the Invention

This invention relates generally to archery bows and more specifically to an archery bow having a cable guard.

2. Related Art

Compound archery bows have commonly employed cable guards to assist in positioning harness string portions in use of the bow. The cable guards currently in use typically consist of a cylindrical bar connected to and extending generally perpendicularly from a riser or handle portion of an archery bow with the harness string portions slidably carried along the cylindrical bar. Typically, a plastic clip slidably carried by the cylindrical bar is used to connect the harness string portions to the cylindrical bar. The reaction forces generated by the harness string portions against the plastic clip cause the plastic clip to slide along the cylindrical bar with the attendant friction as the plastic clip slides along the cylindrical bar.

SUMMARY OF THE INVENTION

An archery bow has a cable guard with at least one guide pulley rotatably carried by the cable guard to receive at least one harness string portion and maintain the harness string portion out of a user's way while using the bow. The archery bow has a body or riser with a handle portion and a pair of limbs. Each limb has a free end spaced from the handle portion. A separate pulley is rotatably carried adjacent the free end of each limb and at least one string is trained around the pulleys and has a draw string portion and at least one harness string portion. The harness string portion is trained around at least a portion of a guide pulley, and if more than one harness string portion is provided, then each harness string portion may be trained around a separate guide pulley to maintain the harness string portions separate from each other and to maintain each harness string portion in a laterally spaced relation from the drawstring portion.

Some objects, features and advantages of the preferred embodiments include, but are not limited to, keeping the harness string portions from interfering with the drawstring and a user of the bow, maintaining the harness string portions separate from one another, reducing wear of the harness strings, reducing friction and side loading of the strings to improve the efficiency of the bow and increase the arrow speed, and providing for adjustment of the cable guard to allow a user to quickly tune the bow to a desired setting.

BRIEF DESCRIPTION OF THE DRAWINGS

These and other objects, features and advantages of this invention will be apparent from the following detailed description of the preferred embodiments and best mode, appended claims, and accompanying drawings in which:

DETAILED DESCRIPTION OF THE PREFERRED EMBODIMENT

Figure 1:
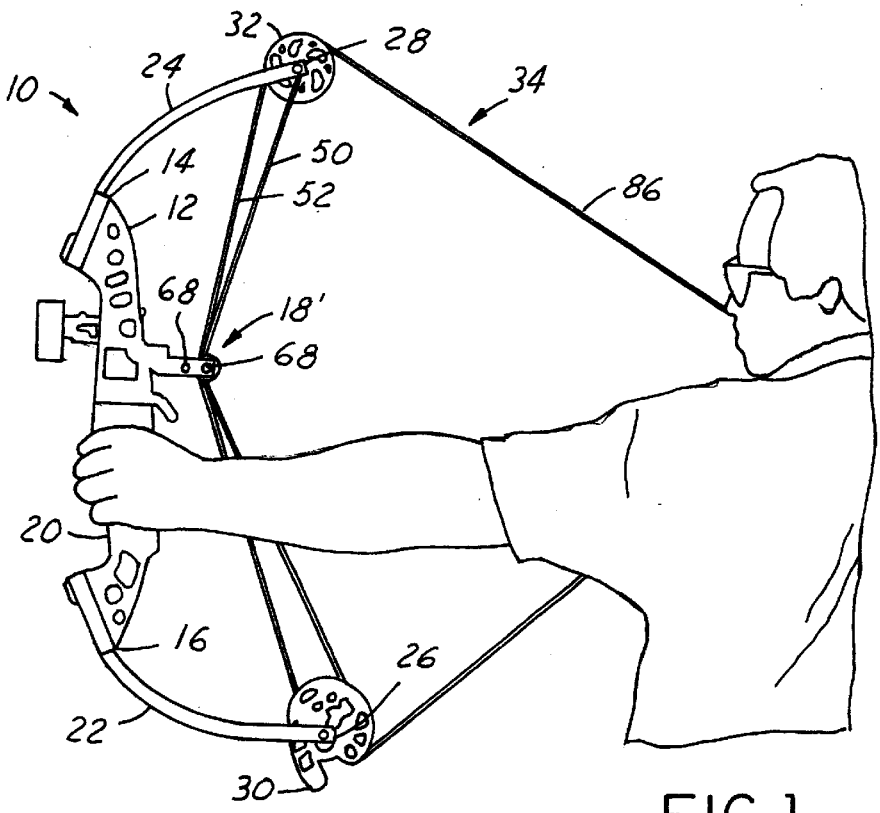
FIG. 1 is a side view showing an archery bow in its fully drawn position and having a cable guard.

Referring in more detail to the drawings, FIG. 1 illustrates an archery bow 10 with a cable guard 18 adapted to laterally displace a pair of harness string portions 50, 52 and maintain them out of the way of a drawstring portion 86 of the bow 10. The bow 10 has a body or riser 12 with opposed ends 14, 16, an arrow rest 17, a handle portion 20 between the ends 14, 16, and a pair of limbs 22, 24. Each limb 22, 24 extends from a separate one of the ends 14, 16 of the riser 12, respectively, and has an opposed free end 26, 28, respectively, spaced from the riser 12. In the embodiment shown, a pulley or cam 30 is carried by one limb 22 adjacent its free end 26, a pulley or idler wheel 32 is carried by the other limb 24 adjacent its free end 28, and a bowstring 34 is trained around both the cam 30 and the idler wheel 32. The bowstring 34 defines the harness string portions 50, 52 and the drawstring portion 86 that is drawn by an archer to propel an arrow in use. As the bowstring 34 is drawn away from the riser 12 to store energy in the limbs 22, 24 and then released to propel an arrow (not shown) towards a target, the bowstring 34 travels in a generally linear fashion in a draw plane 36. The cable guard 18 separates the harness string portions 50, 52 from one another, and maintains these portions of the string 34 laterally offset from the drawstring portion 86 in the area of the arrow rest 17 so that the archery bow 10 can be operated without the harness string portions 50, 52 interfering with the drawstring portion 86, the arrow, or the user.

Figure 2:
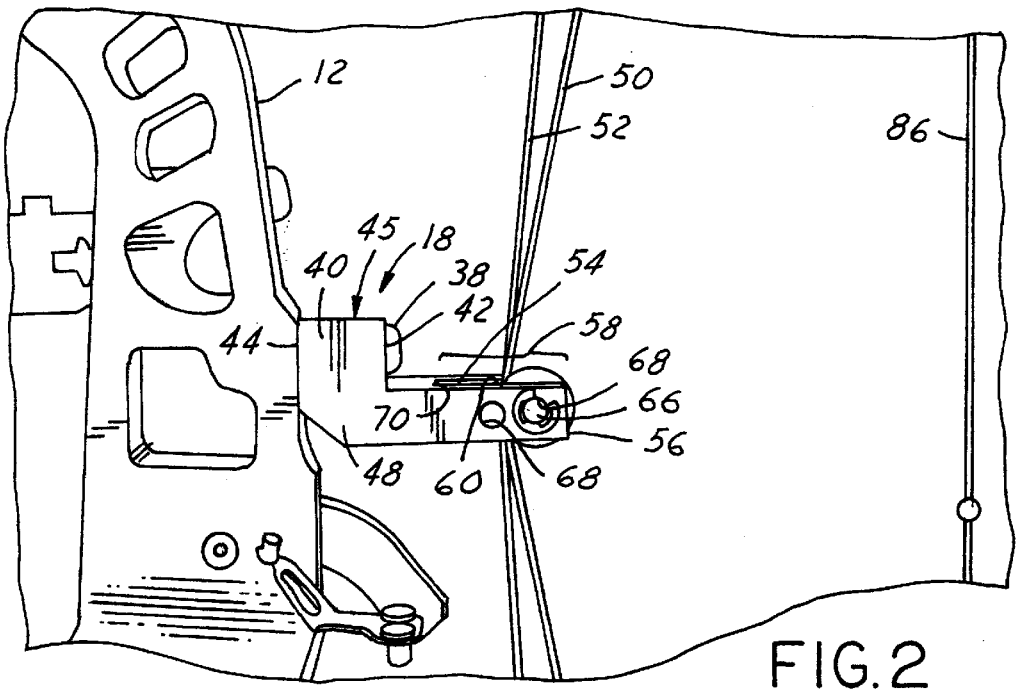
FIG. 2 is a enlarged fragmentary side view of a portion of the archery bow showing the cable guard in more detail.
Figure 3:
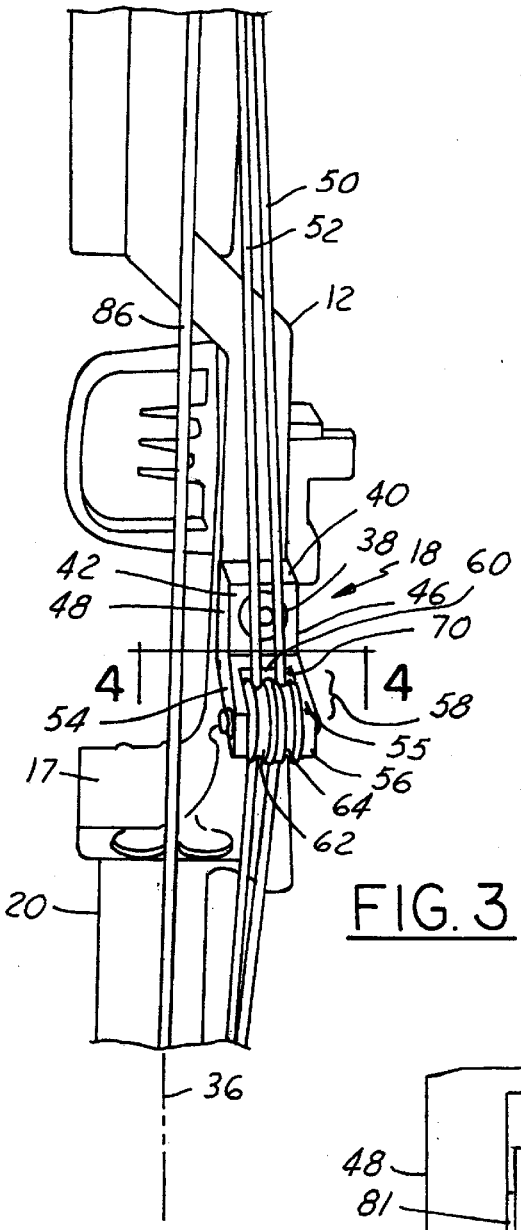
FIG. 3 is a fragmentary rear view of the archery bow showing the cable guard, harness string portions, and draw string.

As best shown in FIGS. 1–3, the bowstring 34 forms the drawstring portion 86 and preferably at least one segment of a harness string portion 52 between the idler wheel 32 and the cam 30. The bow string 34 is shown here having one end attached to the cam 30; being entrained about the idler wheel 32, and returning so that the other end of the bow string 34 is attached to the cam 30. Preferably, another harness string portion 50 has one end attached to the cam 30 and another end having bifurcated string portions attached adjacent the free end 28 of limb 24.

As best shown in FIGS. 2–3, the cable guard 18 is attached to the riser 12 of the bow 10 using a fastener, shown here as a bolt 38. The cable guard 18 has a mounting flange 40 preferably having a through hole passing between an outer face 42 and a mounting face 44 to receive the bolt 38. However, it should be recognized that a cable guard 18' can be made integrally as one piece with the riser 12, as shown in FIG. 1, or the cable guard can be fastened or mounted to the bow 10 in any other suitable way.

The cable guard 18 has a body 45 with a pair of opposed sides 46, 48. The body 45 is mounted to the riser 12 such that one side 46 faces away from the draw plane 36 and the other side 48 faces toward the draw plane 36. The side 48 that faces the draw plane 36 is adequately spaced from the draw plane 36 so that harness string portions 50, 52 trained around the cable guard 18 are maintained spaced laterally away or are offset from the draw plane 36 and drawstring portion 86.

The body 45 has a pair of spaced apart arms 54, 55 that extend outwardly beyond the outer face 42 of the mounting flange 40 and away from the riser 12. The arms 54, 55 each have a free end 56 and are of a length sufficient to rotatably carry at least one and preferably a pair of guide pulleys 62, 64 between them. At least one hole 68 passes through the arms 54, 55 to receive a shaft 66 on which the guide pulleys 62, 64 are mounted. The shaft 66 extends beyond both sides 46, 48 of the arms 54, 55 and preferably has an annular groove (not shown) adjacent both ends 82 of the shaft 66 such that an e-clip, a C-clip, or pair of C-clips 84, can be used to secure the shaft 66 within the holes 68 of the arms 54, 55. It should be recognized that other suitable methods of securing the shaft 66 to the arms 54, 55 could be used, such as using nuts threaded onto a shaft 66 having threaded ends, a cotter pin arrangement, etc. Additionally, more than one hole can be provided through the arms 54, 56 so that the position of the shaft 66 and guide pulleys 62, 64 can be adjusted. Adjusting the location of the guide pulleys 62, 64 can alter the effective length and the tension of the bowstring 34 and hence, certain characteristics of the bow such as the draw length and draw weight of the bow 10.

Figure 4:
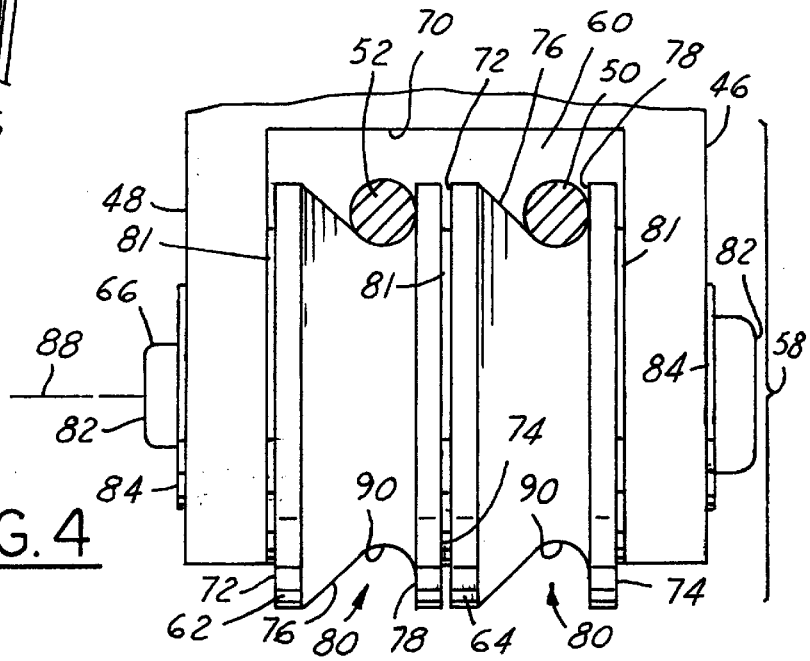
FIG. 4 is an enlarged fragmentary view of the cable guard taken along line 4—4 of FIG. 3.

As best shown in FIG. 4, the guide pulleys 62, 64 are generally similar in shape, and thus only one guide pulley 62 will be discussed, unless specifically mentioned otherwise. The guide pulley 62 has a pair of opposite flat faces 72, 74 and a pair of generally opposed circumferential internal walls 76, 78 defining between them a circumferential groove 80. The slope of the circumferential groove 80 is preferably more gradual or less steep along side 76 so that the harness string portion 50 is somewhat gradually directed to a bottom 90 of the groove 80. This reduces the friction between the guide pulley 62 and the harness string portion 50 compared to that of a U-shaped groove in a pulley with nearly vertical sides. The reduction of friction reduces wear on the strings, vibration, noise, and wear of the bow 10 while in use. To help maintain the string portion 50 in the bottom 90 of the groove 80 side 78 can have a steeper slope.

The guide pulleys 62, 64 are positioned adjacent one another between the arms 54, 55. A washer 81, spacer or the like can be placed between the guide pulleys 62, 64, and between the arms 54, 55 and the guide pulleys 62, 64 to reduce friction, wear, vibration and noise as the guide pulleys 62, 64 rotate relative to one another and typically in opposite directions to one another. Preferably the washers 81 are made of polytetrafluoroethylene or silicon or other suitable low friction materials.

In assembly, the harness string portions 50, 52 are received in part by the guide pulleys 62, 64 so that the harness string portions 50, 52 pass between the guide pulleys 62, 64 and the body 45 of the cable guard 18. The harness string portions 50, 52 are pulled toward the riser 12 (longer arms 54, 55 could reduce or eliminate this) and are moved laterally away from the draw plane 36 and drawstring portion 86. Thus, the harness string portions 50, 52 are moved out of the way of the drawstring portion 86 in the area of the arrow rest 17 on the riser 12 so that they do not interfere with an arrow received on the draw string 86.

Figure 5:
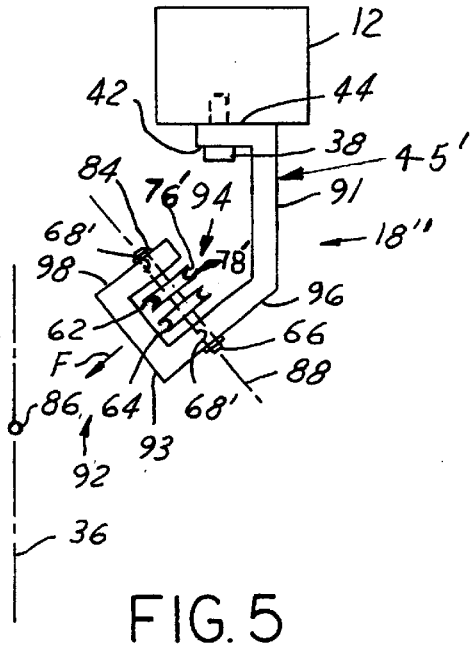
FIG. 5 is a plan view of an alternative embodiment of a cable guard.

In an alternate embodiment, as shown in FIG. 5, the cable guard 18" has a body 45' with an arm portion 91 that has a hook, or generally J-shaped end 92 extending away from the riser 12 providing an opening, or access area 94 facing away from the draw plane 36. Opposed through holes 68' are provided adjacent the end 92 of the arm portion 91 and are positioned to receive the shaft 66 so that the guide pulleys 62, 64 on the shaft 66 have rotational clearance within access area 94 of the arm 91.

Assembly of the shaft 66 and guide pulleys 62, 64 to body 45' is similar to the previous embodiment, and thus will not be discussed in detail. With the J-shaped end 92, the harness string portions 50, 52 are preferably received over the guide pulleys 62, 64 by lifting them over the guide pulleys 62, 64 through the access area 94 of the J-shaped end 92. Therefore, the harness string portions 50, 52 can be trained around the guide pulleys 62, 64 h when the cable guard 18" is fully assembled and mounted on the bow 10. The harness string portions 50, 52 are not contained between the body 45' and the guide pulleys 62, 64 as in the previous embodiment. Desirably, the harness string portions 50, 52 can be disposed on and removed from the guide pulleys 62, 64 when the bow 10 and cable guard 18' are fully assembled.

Additionally, the J-shaped end 92 of the arm portion 91 can be formed such that a longitudinal axis 88 of the shaft 66 receiving the guide pulleys 62, 64 is generally perpendicular to a force F that the harness string portions 50, 52 apply to the guide pulleys 62, 64. This can be achieved by having an end 92 of the arm portion 91 formed on an angle so that after the shaft 66 is installed within the through holes 68' of the arm portion 91, the longitudinal axis 88 of the shaft 66 is generally perpendicular to the reactive force F. By having the shaft 66 generally perpendicular to the reactive force F, the harness string portions 50, 52 tend to remain seated in the bottom 90 of the grooves 80 and the lateral or side loads or forces on the guide pulleys 62, 64 are greatly reduced. In general, this will reduce friction, vibration and wear of the rotating guide pulleys 62, 64 in use. With this arrangement, pulleys 62, 64 may have conventional generally U-shaped grooves with symmetrical walls 76', 78' for receiving the harness string portions.

It will be appreciated by those skilled in the art that modifications and variations of this invention and the preferred embodiments may be made without departing from the spirit and scope of the invention.

What is claimed is:

1. An archery bow, comprising:

a body having a handle portion and a pair of limbs with each limb having a free end spaced from the handle portion and having a separate pulley rotatably carried adjacent to each free end;

a cable guard carried by the body and having a guide pulley rotatably carried by the cable guard; and at least one string trained around the pulleys carried by the limbs providing a draw string portion and a harness string portion that is received on the guide pulley of the cable guard to maintain at least a portion of the harness string portion at a generally fixed distance from the body and laterally spaced from the draw string portion with the amount of said at least a portion of the harness string portion that engages the guide pulley remaining essentially constant when the drawstring portion is drawn and released.

2. The archery bow of 1 wherein the cable guard has a plurality of holes providing for at least two positions to carry the guide pulley.

3. The archery bow of claim 1 wherein the cable guard has an access area for training the harness string portion at least partially around the guide pulley without removing the guide pulley from the cable guard.

4. The archery bow of claim 1 wherein the guide pulley has opposed sides and a groove between the sides with the slope of one side being more gradual than the slope of the other.

5. The archery bow of claim 1 wherein the cable guard has a generally J-shaped arm.

6. The archery bow of claim 1 further comprising a spacer between the guide pulley and the cable guard.

7. The archery bow of claim 6 wherein the spacer is formed of low friction material.

8. The archery bow of claim 1 wherein the cable guard carries a pair of guide pulleys and said at least one string has a pair of harness string portions with each harness string portion received in part by a separate guide pulley.

9. The archery bow of claim 8 further comprising a shaft carried by the cable guard and on which the guide pulleys are mounted.

10. The archery bow of claim 8 further comprising a spacer between the pair of guide pulleys maintaining the guide pulleys spaced from one another.

11. The archery bow of claim 8 wherein said guide pulleys are capable of rotating relative to one another.

12. The archery bow of claim 11 wherein said guide pulleys are operable to rotate in opposite directions to one another.

13. The archery bow of claim 1 which also comprises an arrow rest on the body and wherein in the area of the arrow rest, the cable guard maintains the harness string portion laterally spaced from the draw string portion.

14. The archery bow of claim 1 wherein the cable guard maintains the guide pulley a generally fixed distance from the body.

15. An archery bow comprising:

a body having a handle portion and a pair of limbs with each limb having a free end spaced from the handle portion and having a separate pulley rotatably carried adjacent to each free end;

a cable guard carried by the body and having a guide pulley rotatably carried by the cable guard;

at least one string trained around the pulleys carried by the limbs providing a draw string portion and a harness string portion that is received on the guide pulley of the cable guard to maintain at least a portion of the harness string portion laterally spaced from the draw string portion; and wherein the cable guard and the body are formed as a single piece of material.

16. An archery bow, comprising:

a body having a handle portion and a pair of limbs with each limb having a free end spaced from the handle portion and having a separate pulley rotatably carried adjacent to each free end;

a cable guard carried by the body and having a guide pulley rotatable carried by the cable guard;

at least one string trained around the pulleys carried by the limbs providing a draw string portion and a harness string portion that is received on the guide pulley of the cable guard to maintain at least a portion of the harness string portion laterally spaced from the draw string portion; and which also comprises a shaft carried by the cable guard and on which the guide pulley is mounted, the shaft has a longitudinal axis that is generally perpendicular to a force created by the engagement of the harness string portion with the guide pulley.

17. The archery bow of claim 16 wherein the cable guard has an arm with an angled portion that carries the shaft.

18. An archery bow comprising:

a body having a handle portion and a pair of limbs with each limb having a free end spaced from the handle portion and having a separate pulley rotatably carried adjacent to each free end;

a cable guard carried by the body and having a guide pulley rotatable carried by the cable guard;

at least one string trained around the pulleys carried by the limbs providing a draw string portion and a harness string portion that is received on the guide pulley of the cable guard to maintain at least a portion of the harness string portion laterally spaced from the draw string portion; and wherein the cable guard has a pair of spaced apart arms with the guide pulley received between the arms.

19. An archery bow, comprising:

a body having a handle portion and a pair of limbs with each limb having a free end spaced from the handle portion and having a separate pulley rotatably carried adjacent to each free end;

a cable guard carried by the body and having a pair of guide pulleys carried by the cable guard for rotation relative to one another; and at least one string trained around the pulleys carried by the limbs providing a draw string portion and a pair of harness string portions with each of the harness string portions received on a separate one of the guide pulleys to maintain at least a portion of the harness string portions at a generally fixed distance from the body and laterally spaced from the draw string portion.

20. The archery bow of claim 19 wherein said guide pulleys rotate in opposite directions to one another when the draw string portion is drawn and released.

* * * * *

UNITED STATES PATENT AND TRADEMARK OFFICE

CERTIFICATE OF CORRECTION

PATENT NO. : 6,722,354 B1
DATED : April 20, 2004
INVENTOR(S) : Spencer D. Land

It is certified that error appears in the above-identified patent and that said Letters Patent is hereby corrected as shown below:

Column 4,
Line 46, delete “1” and insert -- claim 1 --.

Column 5,
Lines 40, delete “rotatable” and insert -- rotatably -- .

Column 6,
Line 14, delete “rotatable” and insert -- rotatably --.

Signed and Sealed this

Seventeenth Day of August, 2004

JON W. DUDAS
*Acting Director of the United States Patent and Trademark Office*